United States Patent [19]

Eubank, Jr.

[11] 3,958,352

[45] May 25, 1976

[54] PICTURE FRAME

[76] Inventor: Joseph P. Eubank, Jr., 44 Laurel View Ave., Inverness, Calif. 94937

[22] Filed: Mar. 27, 1975

[21] Appl. No.: 562,492

[52] U.S. Cl. ..... 40/155; 40/152.1

[51] Int. Cl.[2] ..... G09F 1/12

[58] Field of Search ..... 40/152.1, 155; 248/488, 248/490

[56] References Cited

UNITED STATES PATENTS

| | | | |
|---|---|---|---|
| 445,305 | 1/1891 | Tidball | 40/152.1 X |
| 2,524,216 | 10/1950 | Weissman | 40/155 X |
| 3,676,944 | 7/1972 | Eubank | 40/155 |

*Primary Examiner*—Louis G. Mancene
*Assistant Examiner*—Wenceslao J. Contreras
*Attorney, Agent, or Firm*—Smith, Harding, Earley & Follmer

[57] ABSTRACT

A picture frame comprising four pairs of frame members, one pair associated with each corner of the picture assembly. Each pair of frame members at a corner of the picture assembly being adapted to be fitted together in crossed relation with each frame member engaging an edge of the picture assembly near the corner thereof. One of each pair of frame members at a corner of the picture assembly has a cleat exposed on the back side of the picture assembly which is engaged by a cord means extending between each pair of frame members. The cord means is secured in a tensioned condition to urge each pair of frame members together toward a central location of the picture assembly so that a truss-like action is provided with each frame member being urged toward the back of the picture assembly.

10 Claims, 7 Drawing Figures

PICTURE FRAME

BACKGROUND OF THE INVENTION

This invention relates to a picture frame and particularly to picture frames of the type which are adjustable for mounting of pictures of various sizes.

It is desirable to provide an adjustable picture frame which is able to provide a firm mounting for the picture assembly while at the same time preventing warping thereof. My U.S. Pat. No. 3,676,944 discloses a picture frame of this type.

SUMMARY OF THE INVENTION

It is the general object of the invention to provide a picture frame of the type shown in my prior patent and which involves several improved features. For example, the picture frame in accordance with the present invention involves a pair of frame members which are adapted to be secured together by a snap-like fit thereby facilitating the assembly of the picture frame assembly and permitting the picture frame to be changed quickly from one picture to another. Moreover, the improved design involves a minimum number of parts and a minimum cost. Moreover, the new design can be adjusted easily to fit various size picture assemblies.

DESCRIPTION OF THE PREFERRED EMBODIMENT

Figure 1:
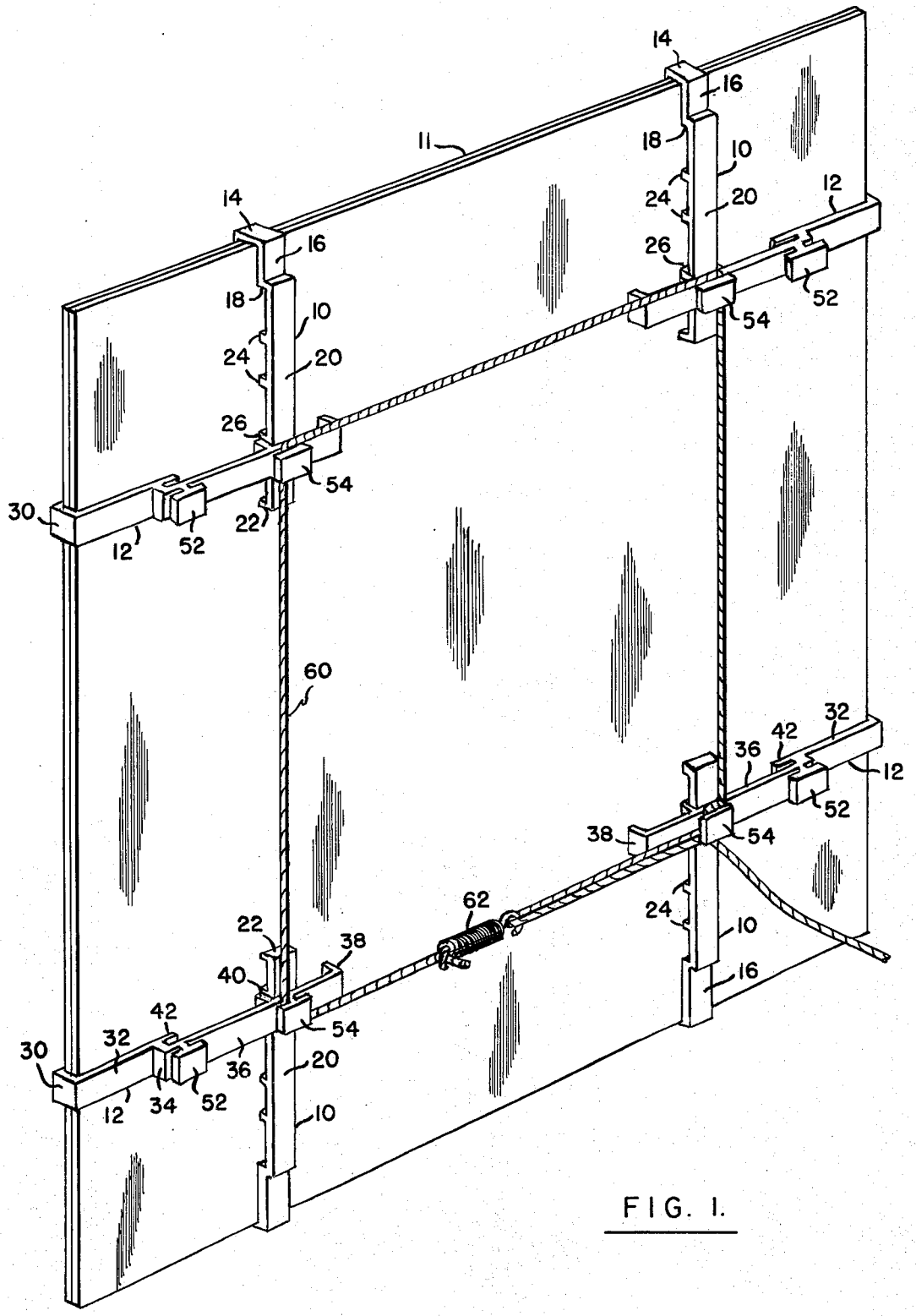
FIG. 1 is a perspective view showing the picture frame in accordance with the invention.

A picture frame in accordance with the invention comprises a frame means associated with each corner of a picture assembly 11 which typically consists of a front pane of glass, a picture and a backing member, such as foamboard. The frame means associated with each corner comprises a pair of frame members 10 and 12 which are secured together in the crossed relation shown in the drawings to extend perpendicularly to an edge of the picture assembly engaged thereby.

Each frame member 10 is made of an elongated onepiece clear plastic (synthetic resin) construction and has a turned end 14 adapted to engage an edge of the picture assembly as is shown in the drawings. Adjacent end 14 is a body portion 16 which extends along the backing of the picture assembly 11 and terminates at a post portion 18. Post portion 18 extends perpendicularly to the body portion 16 away from the picture assembly 11 and transversely across the frame member 10. Extending inwardly from post portion 18 is body portion 20 which terminates at an end post member 22 which extends perpendicularly from body portion 20 and transversely thereacross for contacting the backing of the picture assembly 11. There is also provided two pairs of post members 24 and 26 which extend perpendicularly to body portion 20 and transversely thereacross in the same manner as the end post member 22. The post members 24 and 26 are adapted to engage cooperating portions on frame member 12 for use in securing the frame members 10 and 12 together as will be described hereafter. The pairs of post members 24 and 26 are spaced apart along the length of body portion 20 as shown in the drawings.

Each bracket member 12 is made of a elongated onepiece clear plastic (synthetic resin) construction and has a turned end 30 adapted to engage the edge of the picture assembly 11 as is shown in the drawings. Extending inwardly from turned end 30 and along the picture assembly backing is body portion 32 which terminates in a post portion 34 which extends perpendicularly to body portion 32 and away from the picture assembly backing to join with body portion 36 which extends from post portion 32 to terminate at an end post 38. Body portion 36 is provided with an intermediate post 40 which like posts 34 and 38 extend perpendicularly to body portion 36 and transversely thereacross for contacting the picture assembly backing. Each frame member 12 is provided with a flat foot 42 which extends from post 34 toward end post 38 in spaced parallel relation with body portion 36. Foot 42 is the same width as body portion 36 and is adapted to fit snugly between either pair of posts 24 and 26 on frame member 10. Also, foot 42 is spaced from body portion 36 a distance to permit the insertion of the body portion 20 of frame member 10 into this space by a friction type fit. Frame member 12 is also provided with a foot 44 extending from post 40 toward end post 38 and constructed and arranged in the same manner as the foot 42.

Figure 2:
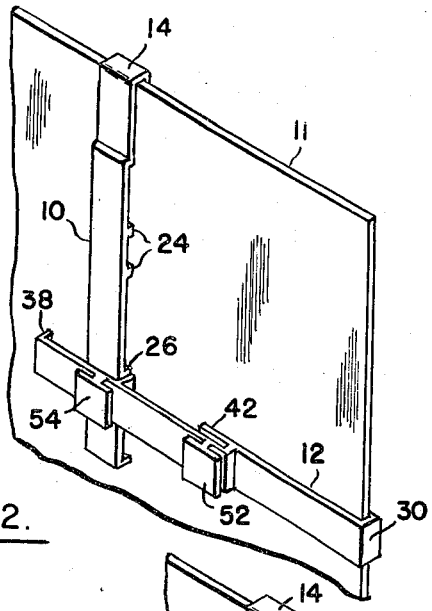
FIGS. 2, 3, 4 and 5 are perspective views showing the four possible combinations of the frame members to accommodate various sizes of picture assemblies.
Figure 3:
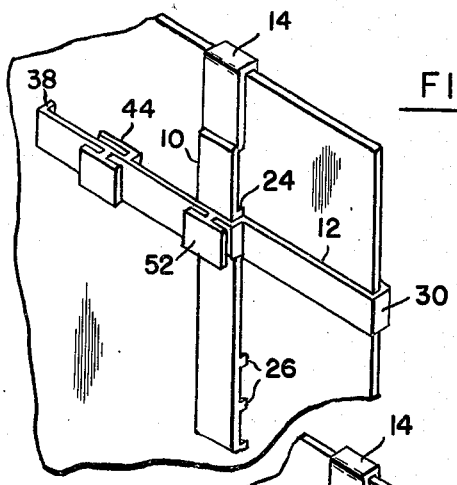
Figure 4:
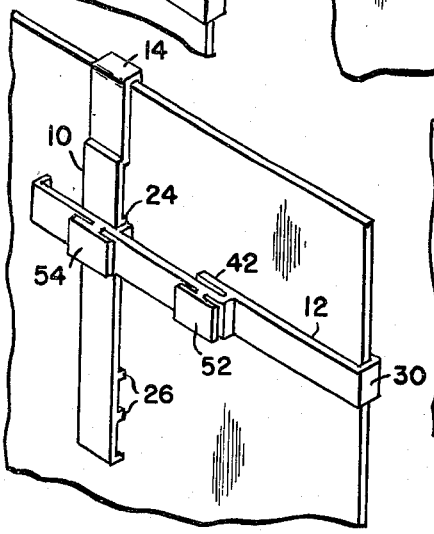
Figure 5:
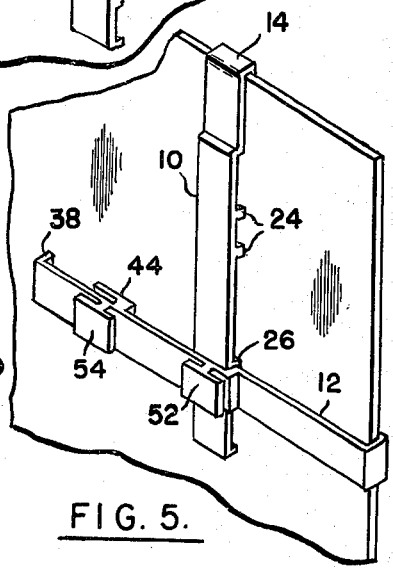

It will be evident that each pair of frame members 10 and 12 are provided with cooperating engaging portions for securing the same together by a friction fit in a crossed relation as shown in the drawings. Thus, the body portion 20 of frame member 10 may be inserted into the space provided between body portion 36 and either foot 42 or 44 with such foot being guided into the space between either pair of posts 24 or 26. Accordingly, the frame members 10 and 12 may be assembled together by a snap-like friction fit in any of the four positions shown in FIGS. 2, 3, 4 and 5. In the arrangement shown in FIG. 2, the parts are assembled in a manner for mounting on a large square. In FIG. 3, the parts are assembled together for mounting on a small square. In FIG. 4, the parts are assembled together for mounting on a horizontal rectangular type of picture assembly. In FIG. 5, the parts are assembled together for mounting on a vertical rectangular type of picture assembly.

It will thus be apparent that each of the four pairs of frame members 10 and 12 are secured together on the back side of a picture assembly 11 at its corners in the crossed relation shown in FIG. 1 by snapping the frame members 10 and 12 together at the cooperating engaging portions thereof. In the assembled condition of the frame members 10 and 12, the ends 14 and 30 engage the edges forming the corners of the picture assembly 11 and the frame members 10 and 12 extend perpendicularly from these edges in the crossed relation as is shown in the drawings.

Means are provided for interconnecting mechanically each of the four pairs of frame members 10 and 12. To this end, each of the frame members 12 is provided with a pair of cleats 52 and 54 which are arranged to project from the body portion 36 in the direction away from the picture assembly backing in the region of the foots 42 and 44 as is best shown in the drawings. Each of the cleats 52 and 54 is formed by a perpendicular post and a flat rectangular foot extending in parallel spaced relation to the body portion 36 as is best shown in the drawings.

There is also provided a cord 60 which is run under the cleats at the intersections of each pair of frame members 10 and 12 at each corner as is shown in FIG. 1. This arrangement forms a generally rectangular cord loop, which loop includes a spring 62 which serves to place the cord 60 under a biased tension condition. The spring 62 is located between the cleats at the bottom of the picture assembly 11 as is shown in FIG. 1 and the cord 60 is run from one end of the spring 62 under all of the cleats 54 and then inserted through the other end of the spring 62 so that the spring is extended slightly. The cord 60 is then run back and looped around the cleat 54 at the bottom right corner as is shown in FIG. 1 and pulled tightly into the slots formed thereby. Alternatively, the cord may be simply tied to the spring 62 with a double knot. This arrangement has the effect of urging each of the frame member pairs inwardly toward the center of the picture assembly and the turned ends 14 and 30 of each frame member into securing engagement with an associated edge of the picture assembly 11. Accordingly, the various parts of the picture frame are secured together and in a manner to provide an excellent support for the picture assembly.

The parts are constructed and arranged so that the force applied by the cord 60 in the tensioned condition to each pair of frame members 10 and 12 at a corner of the picture assembly 11 serves to urge the post members of the frame members toward the picture assembly backing at the points of contact therebetween. Also, the forces applied to the edges of the picture assembly 11 by the frame members have a component in the opposite direction. Accordingly, the forces applied at the posts provide a truss-like action.

In mounting the picture frame on a wall, the cord 60 may be engaged with either one or two hangers extending from the wall. The upper horizontal leg of the rectangular cord loop is used for this purpose. When mounted on a wall the foot portions of the cleats serve as wall contacting members and also serve to separate the cord 60 from the wall to allow the picture frame assembly to hang parallel to the wall.

Figure 6:
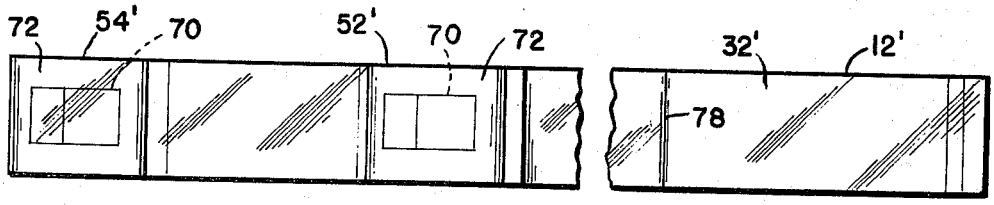
FIG. 6 is a plan view of a frame member in accordance with the invention.
Figure 7:
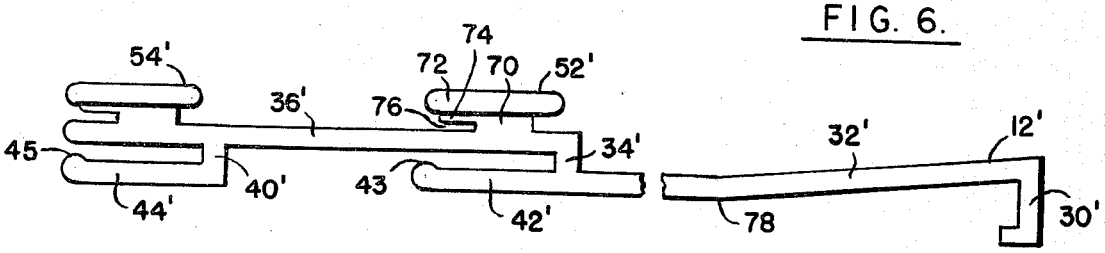
FIG. 7 is an elevational view of the frame member shown in FIG. 6.

In FIGS. 6 and 7 there is shown another form of the frame member 12. This frame member is indicated at 12′ and since it is similar to the frame member 12 corresponding parts are given the same reference numerals with primes added. Frame member 12′ is made of a one-piece clear plastic construction and comprises a turned end 30′ adapted to engage the edge of the picture assembly 11. There is also provided a body portion 32′ which terminates in a perpendicular post 34′ and a body portion 36′ which joins with the post 34′. Frame member 12′ comprises a second post 40′ and a pair of foots 42′ and 44′ which extend from posts 34′ and 40′, respectively, for engaging an associated frame member 10 as was described above. Foots 42′ and 44′ are provided with ridges 43 and 45, respectively, for retaining the frame members 10 in the engaged position.

Frame member 12′ is provided with a pair of cleats 52′ and 54′ which are somewhat different from the corresponding parts on frame member 12. Since these cleats 52′ and 54′ are identical, only one will be described in detail. Thus, cleat 52′ is provided with a generally rectangular post portion 70 which is generally centered below a rectangular foot portion and has a smaller cross-section than foot portion 72. Extending inwardly from the wall of post 70 facing the inner end of frame member 12′ is a wall portion 74 which defines a narrow slot 76 adapted to have the cord 60 forced therein for securing the same in a fixed position. The space provided between foot 72 and the body portion 36′ along the outer end and sides of the post 70 is large enough to permit the cord 60 to slide therein.

By reason of the above described construction, the cord 60 can be secured in position by pulling it into the slot 76 while the cord 60 is free to slide through the front and sides of the cleat 52′ so that the spring action provided by the spring biased cord 60 can act around all four sides of the truss. Moreover, since the post 70 is centered below the foot portion 72, the frame member 12′ can be used on the side, the top, or bottom of the picture assembly 11 without offsetting the cord 60.

As shown in FIG. 7, body portion 32′ is provided with a bend at 78 which serves to raise the end 30′ above the plane of the portions of the frame member 12′ which contact the picture assembly backing. Thus, the frame member 12′ must be bent to flatten body portion 32′ against the picture assembly backing when mounted on the picture assembly. Accordingly, the end 30′ will be forced tight against the front part of the picture, namely, the glass, while the bottom portion of the frame member at 42′ and 44′ is forced tightly against the backing of the picture assembly.

It will be apparent that various changes may be made in the construction and arrangement of parts without departing from the scope of the invention.

I claim:

1. A picture frame comprising a frame means for each corner of a rectangular picture assembly, each frame means including a pair of frame members, each frame member having one end formed to engage an edge of the picture assembly, each pair of frame members being provided with cooperating engaging portions for securing the pair of frame members together in crossed relation by a friction fit at a first location and second cooperating engaging portions for securing the pair of frame members together in crossed relation by a friction fit at a location spaced from said first location, one of said pair of frame members of each frame means providing a cleat arranged to be positioned on the back side of the picture assembly in spaced relation therefrom, and cord means extending between each of said frame means and engaging each of said cleat means on said one frame member thereof, said cord means being secured in a tensioned condition to urge said frame means at each corner of the picture assembly together and toward a central location of the picture assembly, to urge said frame members toward contact with the back side of the picture assembly and to urge said picture frame assembly engaging end of each frame member into securing engagement with an associated edge of the picture assembly.

2. A picture frame according to claim 1 wherein each of said frame members is made of a one-piece construction including said cooperating engaging portions thereof.

3. A picture frame according to claim 2 wherein each of said frame members is made of plastic.

4. A picture frame according to claim 1 wherein said cleats are formed to provide a flat foot portion adapted to contact a wall on which the picture assembly is hung and to provide a cord engaging recess which positions the cord so as to be separated from the wall.

5. A picture frame according to claim 1 wherein said cooperting engaging portions for securing a pair of frame members together comprises a pair of spaced transversely extending posts on one of said frame members and a portion on the other of said frame members adapted to be received between said posts and spaced from the body portion of the other frame member to provide a space adapted to receive the body portion of said one frame member.

6. A picture frame according to claim 1 wherein said cooperating engaging portions for securing a pair of frame members together in crossed relation by a friction fit at said first and second location are adapted to be flexibly engaged to provide a snap fit.

7. A picture frame according to claim 1 wherein said cord means is looped around said cleat and has one end thereof connected to a tension spring and the other end thereof looped around one of said cleats after engagement with the other end of the tension spring.

8. A picture frame according to claim 1 wherein each of said cleats is provided by a rectangular post extending perpendicularly to the body portion of said one frame member and a foot portion adapted to contact the wall on which the picture assembly is mounted.

9. A picture frame according to claim 8 wherein each of said cleats has a wall portion defining a narrow slot on the inner side of said rectangular post for tightly engaging a cord member forced therein.

10. A picture frame according to claim 1 wherein each frame member has a first body portion extending inwardly from said end engaging the picture assembly, a post portion at the inner end of said first body portion and extending perpendicularly thereto, and a second body portion extending inwardly from said post portion and supporting said cleat thereon, said first body portion having a bend therein so that said frame member must be bent to flatten said first body portion against the back side of the picture assembly when mounted thereon.

* * * * *